United States Patent [19]

Uekido et al.

[11] Patent Number: 5,026,306

[45] Date of Patent: Jun. 25, 1991

[54] CONNECTOR SUITABLE FOR HIGH-SPEED TRANSMISSION OF SIGNALS

[75] Inventors: Kouzou Uekido; Michiaki Nishiyama, both of Tokyo; Katsuhiko Sakamoto, Kanagawa, all of Japan

[73] Assignee: NEC Corporation, Tokyo, Japan

[21] Appl. No.: 499,555

[22] Filed: Mar. 26, 1990

Related U.S. Application Data

[63] Continuation of Ser. No. 253,589, Oct. 5, 1988, abandoned.

[30] Foreign Application Priority Data

Oct. 5, 1987 [JP] Japan ..... 62-251265

[51] Int. Cl.[5] ..... H01R 17/18

[52] U.S. Cl. ..... 439/675; 439/729; 439/787; 439/796

[58] Field of Search ..... 439/95, 96, 98, 99, 439/101, 108, 63, 578-585, 607, 608, 787, 868, 883, 45, 49-53, 860, 721, 723, 724, 725, 729, 786, 796, 675

[56] References Cited

U.S. PATENT DOCUMENTS

| | | | |
|---|---|---|---|
| 1,722,816 | 7/1929 | Meunier . | |
| 3,162,503 | 12/1964 | Warzecka | 439/721 |
| 3,354,421 | 11/1967 | Rodgers, III | 439/721 |
| 3,825,874 | 7/1974 | Peverill | 439/579 |
| 3,852,700 | 12/1974 | Haws | 439/98 |
| 3,963,301 | 6/1976 | Stark . | |
| 4,012,095 | 3/1977 | Doucet et al. | 439/63 |
| 4,017,696 | 4/1977 | Falk . | |
| 4,131,934 | 12/1978 | Becker et al. . | |
| 4,231,629 | 11/1980 | Kirby . | |
| 4,579,406 | 4/1986 | Laursen et al. . | |
| 4,580,863 | 4/1986 | Lohr et al. | 439/724 |
| 4,611,873 | 9/1986 | Punako et al. | 439/578 |
| 4,612,601 | 9/1986 | Watari . | |
| 4,707,040 | 11/1987 | Hansell, III | 439/98 |
| 4,767,341 | 8/1988 | Lund . | |
| 4,819,131 | 4/1989 | Watari . | |
| 4,898,538 | 2/1990 | Tratar et al. . | |
| 4,934,941 | 6/1990 | Okada . | |

FOREIGN PATENT DOCUMENTS

| | | |
|---|---|---|
| 224456-A | 3/1987 | European Pat. Off. . |
| 60-68570 | 4/1985 | Japan . |

OTHER PUBLICATIONS

IBM Technical Disclosure Bulletin, vol. 21, No. 10, Mar. 1979, "Coaxial Connector", R. E. Heath et al.

TELF, vol. 4, 87-151881/22, EP 224,456 "Coaxial Connector for Conductor-Stripline Junction-Has Plug With Central Pin and Planar Surface to Enable Connections by Bonding Techniques", Telefon ABLMericsson 03.10.85-SE004588.

*Primary Examiner*—David L. Pirlot

*Attorney, Agent, or Firm*—Burns, Doane, Swecker & Mathis

[57] ABSTRACT

A connector including a housing having a first surface and a plurality of first bores extending from the first surface for respectively receiving coaxial pins. The connector further includes a flat member made of an electrically conductive material and disposed in the housing so as to face the first bores, and first arms are formed from portions of the flat member which are associated one-to-one with the first bores for electrical connection to respective outer conductors of the coaxial pins. The connector further includes a plurality of second bores extending toward the flat member from a second surface of the housing which is opposite to the first surface for respectively receiving ground pins, and second arms formed from portions of the flat member which are associated one-to-one with the second bores for electrical connection to respective ground pins.

82 Claims, 5 Drawing Sheets

CONNECTOR SUITABLE FOR HIGH-SPEED TRANSMISSION OF SIGNALS

This application is a continuation of application Ser. No. 07/253,589, filed Oct. 5, 1988 now abandoned.

BACKGROUND OF THE INVENTION

The present invention relates to a connector suitable for the high-speed transmission of signals.

In parallel with the increase in the operation speed of a computer or similar electronic apparatus, a demand for a connector capable of repeating high-speed signals with accuracy is increasing. The high-speed signals refer to those signals having frequencies above gigahertz order, for example.

An example of prior art connectors elaborated to meet the above demand is disclosed in Japanese Patent Disclosure (Kokai) No. 60-68570. The connector shown and described in this Patent Disclosure, however, has a disadvantage that the frequencies of signal with which their waveforms can be transmitted accurately are limited, as discussed in detail later.

SUMMARY OF THE INVENTION

An object of the invention is, therefore, to provide a connector free from the above-mentioned disadvantage of the prior art connector.

According to an aspect of the invention, there is provided a connector which comprises: a plurality of coaxial pins each having an inner conductor connected to a signal line of a coaxial cable, an outer conductor connected to a ground line of the coaxial cable, and an insulator providing electrical insulation between the inner conductor and the outer conductor; a housing having a first surface and a plurality of first bores extending from the first surface for receiving the coaxial pins, each of the first bores having a predetermined length; a flat member made of a good electrically conductive material and disposed in the housing to face the first bores; first arms formed by cutting and raising those portions of the flat member which are associated one-to-one with the first bores, the first arms being electrically connected to the outer conductors of the coaxial pins; a plurality of second bores extending toward the flat member from a second surface of the housing which is opposite to the first surface and receiving ground pins; second arms formed by cutting and raising those portions of the flat member which are associated one-to-one with the second bores, the second arms being electrically connected to the ground pins.

BRIEF DESCRIPTION OF THE DRAWINGS

Other features and advantages of the invention will become more apparent from the following detailed description when taken in conjunction with the accompanying drawings in which.

In the drawings, the same reference numerals represent the same structural elements.

DESCRIPTION OF THE PREFERRED EMBODIMENTS

Figure 1:
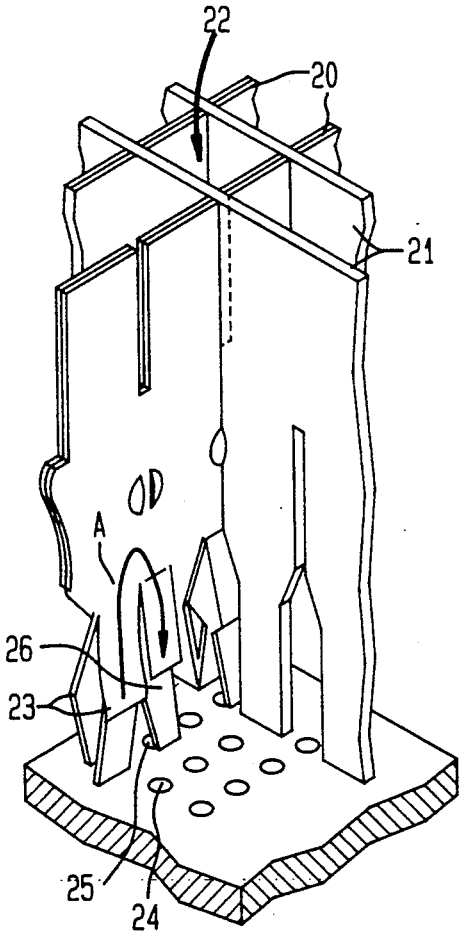
FIG. 1 is a fragmentary perspective view of a prior art connector.

To better understand the invention, a brief reference will be made to a prior art connector as disclosed in the above-mentioned Patent Disclosure referring to FIG. 1. The connector includes conductive plates 20 and 21 which are combined in a lattice configuration to form a number of prismatic hollow spaces 22.

Coaxial pins (not shown) are connected to one ends of coaxial cables (not shown) and inserted into the spaces 22 from above as viewed in the figure, respectively. The coaxial pin received in any one of the spaces 22 is held between contact portions 23. On the other hand, signal pins are individually inserted into deep recesses of the coaxial pins from below through openings 24, whereby the signal pins and signal lines of the coaxial cables are individually electrically interconnected. Further, ground pins are inserted into openings 25 and held between contact portions 26 of the plates 20 and 21. This provides electrical connection between a ground line of each of the coaxial cables and an associated one of the ground pins along a path which is indicated by an arrow A in FIG. 1. In this manner, numerous coaxial pins are inserted from above while numerous signal pins and ground pins which alternate with each other are inserted from below so as to set up electrical connection between the signal lines of coaxial cables and the signal pins associated with the signal lines. At the same time, each of the ground lines of the coaxial cables is electrically connected to an associated one of the ground pins. The connector with such a configuration is ready to transmit signals.

The prior art connector described above has a disadvantage that in those portions where the plates 20 and 21 combined in a lattice configuration and held at ground potential make contact with each other, impedance is developed due to such a contact. The connector has another disadvantage that the contact portions 23 of the plates 20 which the coaxial pins individually contact and the contact portions 26 which the ground pins individually contact are electrically interconnected by the conductive path A having a substantial length. For these reasons, the frequencies of signals with which their waveforms can be transmitted with accuracy are limited.

Figure 2:
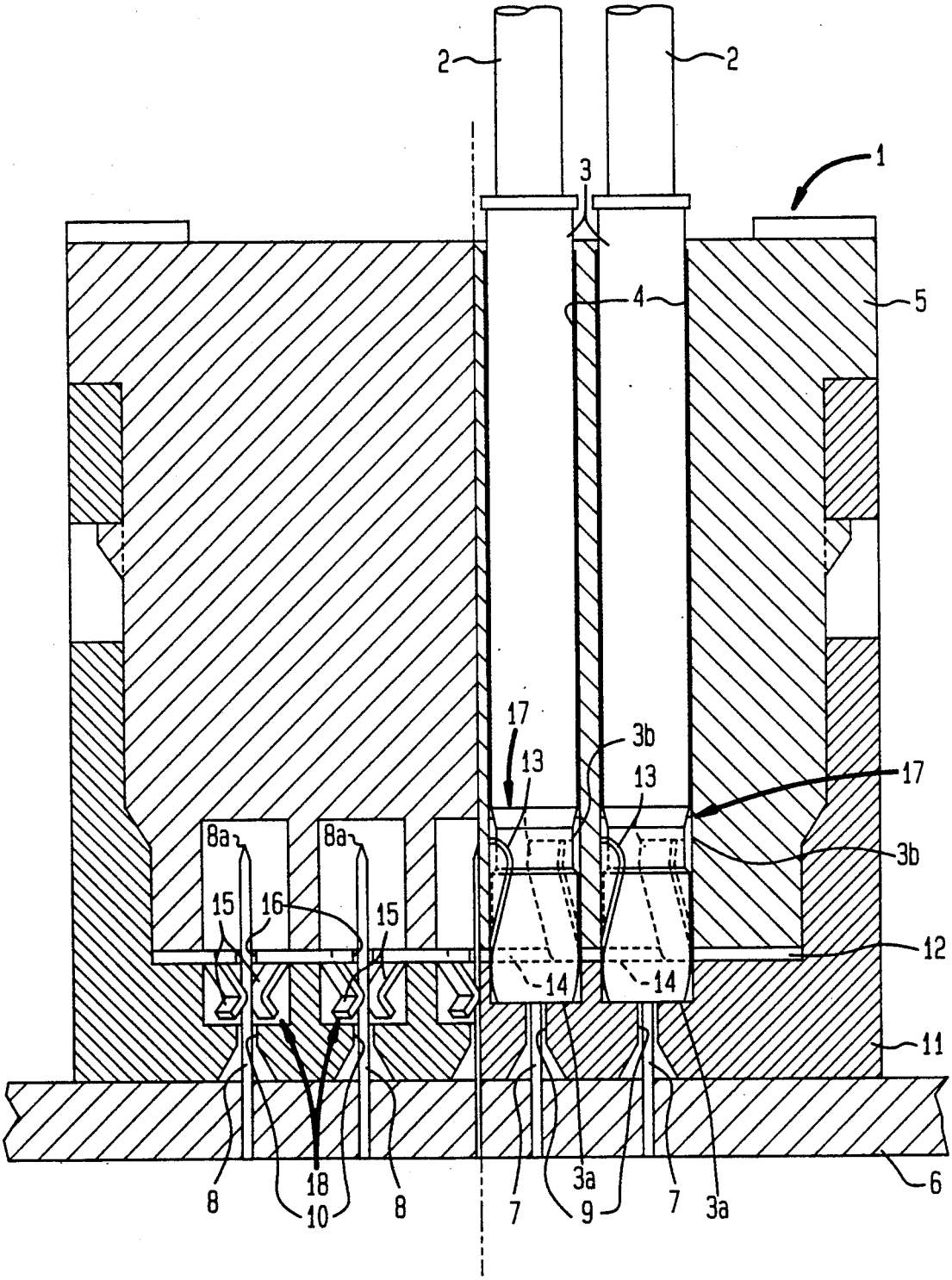
FIG. 2 is a cross-sectional view of a first embodiment of the invention.

Referring to FIG. 2, a first embodiment of the invention is shown and generally designated by the reference numeral 1. The right half of the figure shows those positions where coaxial pins 3 and signal pins 7 are inserted while the left half shows those positions where ground pins 8 are inserted.

The connector 1 comprises a coaxial pin housing 5 provided with a number of deep bores 4. The pins 3 connected to respective coaxial cables 2 are inserted into the respective bores 4 of the housing 5. A number of signal pins 7 and ground pins 8 are implanted in and studded on a substrate 6. The signal pins 7 engage with the respective pins 3. A ground pin housing 11 is formed with a group of bores 9 and another group of bores 10 which receive the pins 7 and the pins 8, respectively. A single thin plate of metal 12 is held between the housings 5 and 11 and extends substantially perpendicular to the direction of insertion of the pins 3, 7 and 8.

The plate 12 is cut and raised to form resilient pieces or arms 13 at those positions of the plate 12 where the pins 3 inserted in the bores 4 from above intersect the plate 12. As shown in the figure, the arms 13 extend in the opposite direction to the direction in which the pins 3 are inserted into the bores 4. Each of the pins 3 is formed with circumferential recesses 3*b* on its outer periphery. When the pins 3 are received in the bores 4, they are individually resiliently retained by the arms 13. The plate 12 are also formed with openings 14 in the vicinity of the arms 13 so that the pins 3 are retained with their tips 3*a* penetrating the plate 12 through those openings 14. In this manner, coaxial pin contacts 17 are formed in one-to-one correspondence with the pins 3.

The diameter of each of the bores 4 is small enough to allow the pin 3 to be inserted smoothly but closely. As shown in the figure, the depth of each of the bores 4 is about four times greater than the height of each of the arms 13. Such a configuration causes each of the pins 3 to be inserted between associated ones of the arms 13 perpendicularly from above as viewed in the figure. In other words, it prevents the pin 3 from being inserted with the pin 3 inclined or shifted to the side. As a result, the arms 13 are safeguarded against damage in the event of insertion of the pins 3. When the pins 3 are inserted into the bores 4, the pins 3 are brought into positive contact with the arms 13 at their outer periphery while the pins 3 are surely retained by the arms 13.

The pins 7 are inserted into the pins 3, which are received in the openings 14 and retained by the arms 13, through the bores 9 from the tips 3*a* of the pins 3. This provides electrical connection between the signal lines of the cables 2 and the pins 7.

The pins 8 are inserted into the bores 10 simultaneously with the insertion of the pins 7 into the bores 9. The plate 12 is cut and raised at those positions of the plate 12 where the pins 8 penetrate so as to form resilient arms 15. The arms 15 extend in the opposite direction to the direction of insertion of the pins 8. Each of the pins 8 is resiliently retained by associated ones of the arms 15 to form ground pin contacts 18. In this instance, the tips 8*a* of the pins 8 penetrate openings 16 which are defined between the arms 15.

A prerequiste with the plate 12 is that the arms 13 and 15 be capable of retaining the pins with a sufficient degree of resilience and have a sufficient electrical-conductivity with respect to high frequencies. To meet this prerequisite, the plate 12 may be implemented by a plate of stainless steel plated with gold by way of example.

Figure 3:
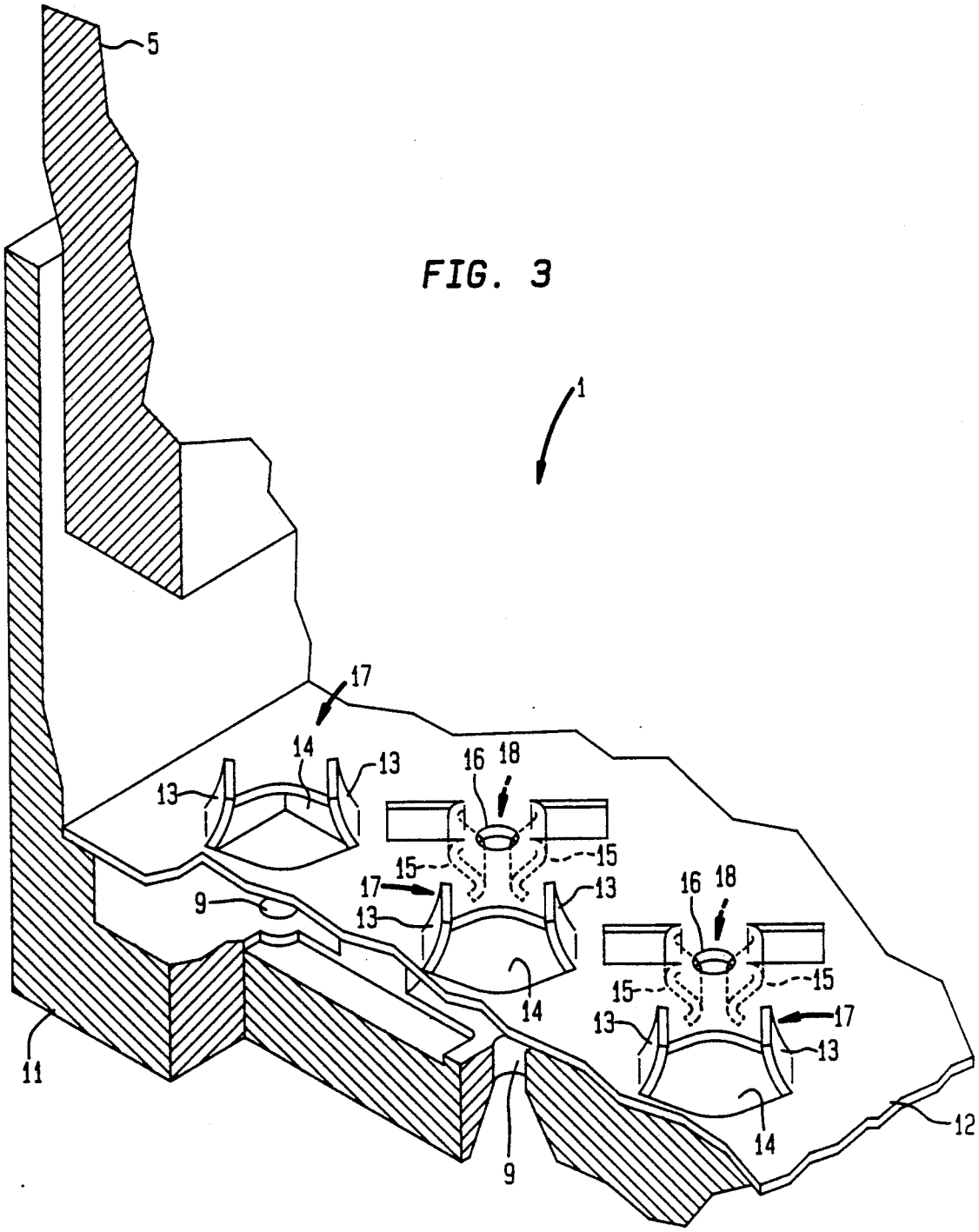
FIG. 3 is a perspective view of a thin metal plate used in the embodiment of FIG. 2.

As shown in FIG. 3, the contacts 17 and 18 are located in close proximity to each other so that the outer surfaces of the pins 3 and those of the ground pins 8 are electrically interconnected at the shortest distance.

In the embodiment, the pins 3*a* are retained with their tips 3*a* penetrating downward the openings 14 of the plate 12. Alternatively, an arrangement may be made such that the pins 7 penetrate the plate 12 upward through the openings 14 into the pins 3 whose tips 3*a* are located above the openings 14. Likewise, the ground pins 8 may be reduced in length such that their tips 8*a* are positioned below the plate 12, in which case the openings 16 are omissible. Further, the arms 13 and 15 may be raised to extend in the opposite direction to the direction as shown in FIG. 2, that is, such that the arms 13 extend in the same direction as the insertion direction of the pins 3 and the arms 15 extend in the same direction as the insertion direction of the pins 8. If desired, the arms 13 and 15 may even be so formed as to extend in the same direction. In these modifications, the configurations of the two housing 5 and 11, the configurations and lengths of the respective pins should be changed in matching relation to the direction in which the arms 13 and 15 extend.

Figure 4:
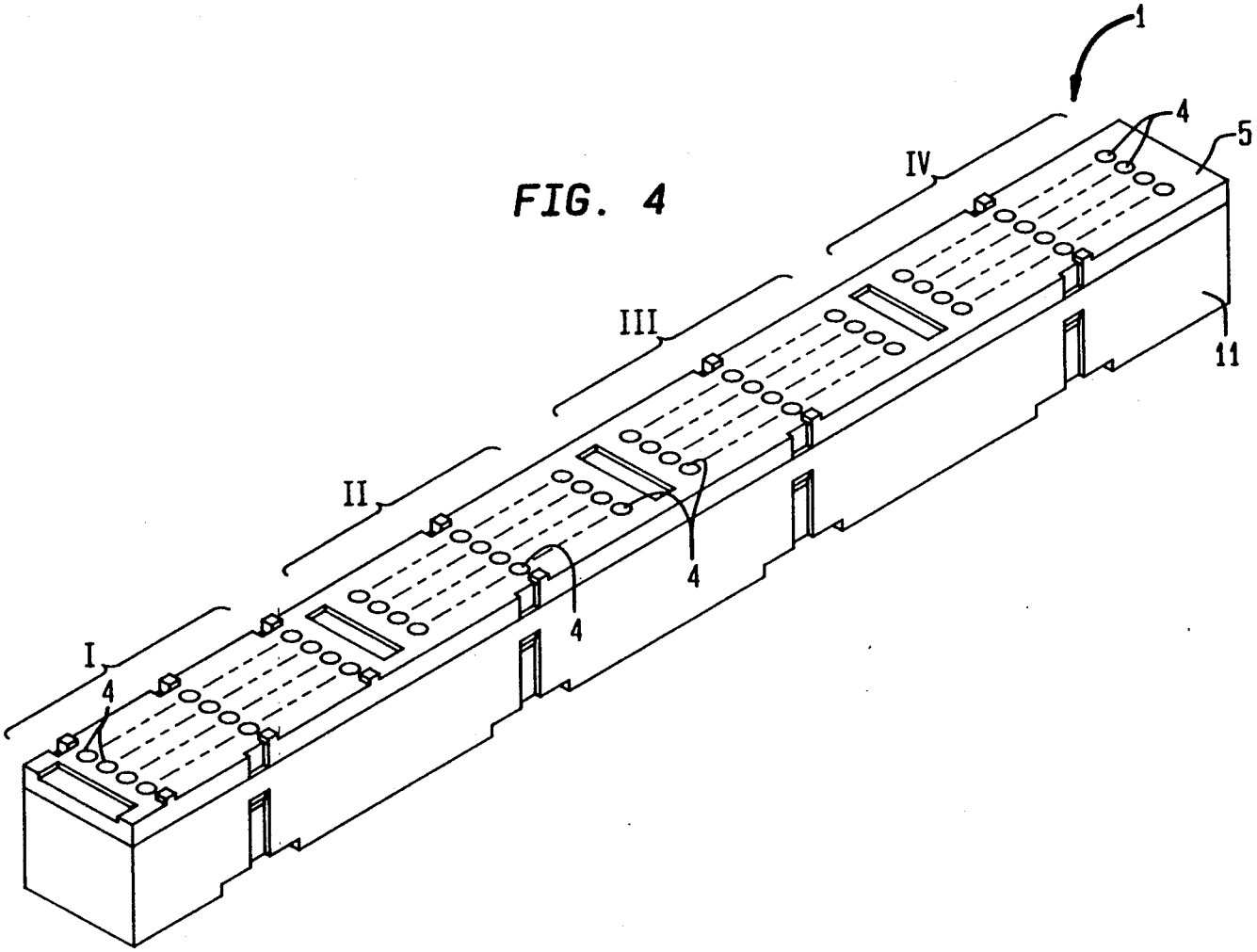
FIG. 4 is a perspective view of a general construction of a connector in accordance with the invention.

Referring to FIG. 4, a general construction of the connector 1 in accordance with the present invention is shown in a perspective view with the bores 4 facing upward. In the figure, dash-and-dot lines shown that the bores 4 having the same configuration are positioned in arrays. Coaxial pins are inserted from above into the bores 4 while, at the same time, the same number of signal pins and ground pins as the coaxial pins are inserted from below into the connector 1, whereby electrical connection is established as described earlier with reference to FIGS. 2 and 3.

In the specific construction shown in FIG. 4, the connector 1 is divided into four blocks I, II, III and IV. This is to prevent, for example, the coaxial pins from failing to be inserted between their associated resilient arms 13 due to errors particular to various kinds of machining such as forming the housings 5 and 11 and cutting and raising the plate 12. If the connector 1 is not divided into blocks and the plate 12 is implemented by a single elongate plate, those errors would accumulate to bring about the above-described insertion failure in a part of the connector 1. In the first embodiment, the connector 1 is made up of a plurality of blocks each including one short metal plate 12. Dividing the connector into four blocks as shown and described is only illustrative. The gist is that one block be shorter than a particular length which is determined on the basis of the above-described errors, a mounting accuracy required and so on.

Figure 5:
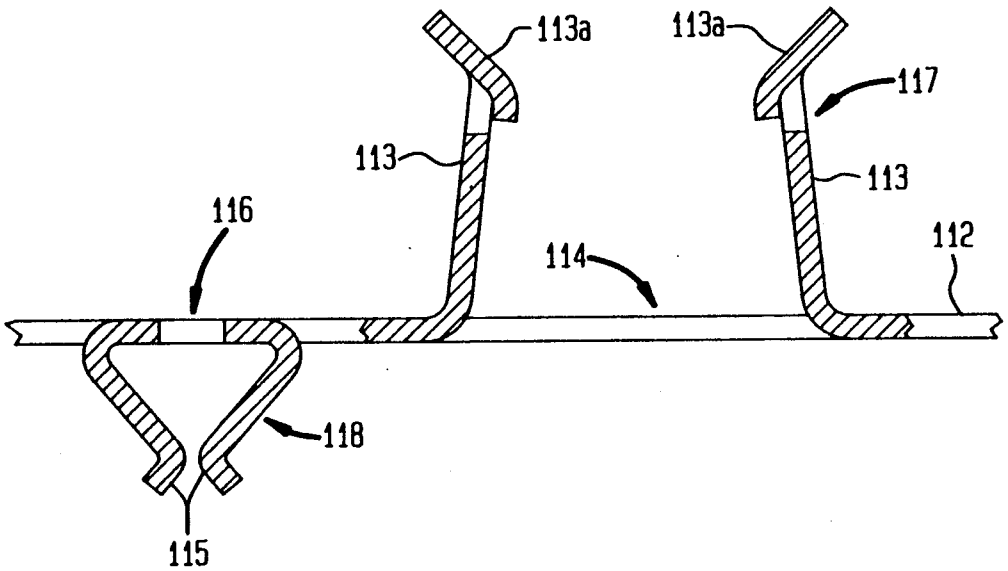
FIG. 5 is a cross-sectional view of a thin metal plate applicable to a second embodiment of the invention.

Referring to FIG. 5, a second embodiment of the invention is shown which comprises a thin metal plate 112 in place of the thin metal plate 12 of FIGS. 2 and 3. As shown, the plate 112 is cut and raised to form resilient arms 113 at its positions for receiving the coaxial pins 3 (FIG. 2). A coaxial pin contact 117 is provided for interconnecting any of the pins 3 and its associated signal pin 7 (FIG. 2) through an opening 114 which is formed between the arms 113. The plate 112 is also cut and raised to form another group of resilient arms 115 at its positions for receiving the pins 8 (FIG. 2). A ground pin contact 118 is provided in which any of the pins 8 is inserted through an opening 116 of the plate 112.

In the second embodiment, upper portions of the resilient arms 113 are further cut and raised to form pawls 113*a*. In this configuration, when any of the pins 3 is inserted into the opening 114, the pawls 113*a* of the arms 113 snap into the recesses 3*b* of the pin 3 and in the resulting position prevent the pin 3 from slipping out of the connector 1 except when the pin 3 is intentionally pulled with an extraordinary force. In this manner, the pawls 113*a* help their associated resilient arms 113 surely retain the pin 3 within the connector 1.

While this invention has been described in conjunction with the preferred embodiments thereof, it will now readily be possible for those skilled in the art to put this invention into practice in various other manners.

What is claimed is:

1. A connector comprising:

a plurality of coaxial pins each having an inner conductor connected to a signal line of a coaxial cable, an outer conductor connected to a ground line of said coaxial cable, and an insulator providing electrical insulation between said inner conductor and said outer conductor;

a housing having a first surface and a plurality of first bores extending from said first surface for receiving said coaxial pins, each of said first bores having a predetermined length;

a flat member made of a good electrically conductive material and disposed in said housing to face said first bores;

first arms formed by cutting and raising those portions of said flat member which are associated one-to-one with said first bores, said first arms being electrically connected to said outer conductors of said coaxial pins;

a plurality of second bores extending toward said flat member from a second surface of said housing which is opposite to said first surface and receiving ground pins; and second arms formed by cutting and raising those portions of said flat member which are associated one-to-one with said second bores, said second arms being electrically connected to said ground pins, wherein said flat member extends in a substantially perpendicular direction to the direction of insertion of said coaxial pins into respective said first bores, said first arms extend in a direction opposite to the direction of insertion of said coaxial pins into respective said first bores, and said second arms extend in a direction opposite to the direction of insertion of said ground pins into respective said second bores.

2. A connector as set forth in claim 1, wherein said predetermined length of each of said first bores is about 4 times greater than the height of each of said first arms.

3. A connector as set forth in claim 1, wherein said first arms are resilient and said coaxial pins are respectively resiliently retained by said first arms and said second arms are resilient and said ground pins are respectively resiliently retained by said second arms.

4. A connector as set forth in claim 3, wherein said first arms have electrical conductivity with respect to high frequencies.

5. A connector as set forth in claim 3, wherein said flat member is made of stainless steel plated with gold.

6. A connector as set forth in claim 1, wherein the upper end of each of said first arms has a pawl for engaging with the outer periphery of a respective one of said coaxial pins.

7. A connector as set forth in claim 6, wherein each said pawl is for engaging with a circumferential recess on the outer periphery of a respective one of said coaxial pins.

8. A connector as set forth in claim 1, wherein said connector is divided into a plurality of blocks, each of said plurality of blocks including a respective portion of said housing, a respective said flat member, respective said first arms, respective said second arms, respective said first bores, and respective said second bores.

9. A connector as set forth in claim 8, wherein said first arms are resilient and said coaxial pins are respectively resiliently retained by said first arms, said second arms are resilient and said ground pins are respectively resiliently retained by said second arms, and each respective said flat member extends in a substantially perpendicular direction to the direction of insertion of said coaxial pins into respective said first bores.

10. A connector as set forth in claim 1, further comprising: third bores extending from said second surface toward said first arms and receiving signal pins to be electrically connected to said inner conductors of said coaxial pins.

11. A connector as set forth in claim 10, wherein said first arms are resilient and said coaxial pins are respectively resiliently retained by said first arms, and said second arms are resilient and said ground pins are respectively resiliently retained by said second arms.

12. A connector as set forth in claim 10, wherein said predetermined length of each of said first bores is about four times greater than the height of each of said first arms.

13. A connector as set forth in claim 10, wherein said connector is divided into a plurality of blocks, each of said plurality of blocks including a respective portion of said housing, a respective said flat member, respective said first arms, respective said second arms, respective said first bores, respective said second bores and respective said third bores.

14. A connector as set forth in claim 13, wherein each respective said flat member extends in a substantially perpendicular direction to the direction of insertion of said coaxial pins into respective said first bores, said first arms are resilient and said coaxial pins are respectively resiliently retained by said first arms, and said second arms are resilient and said ground pins are respectively resiliently retained by said second arms.

15. A connector comprising:

a housing having a first surface and a plurality of first bores extending from said first surface, each of said first bores for respectively receiving a coaxial pin and having a predetermined length, each said coaxial pin having an inner conductor for connection to a signal line of a coaxial cable, an outer conductor for connection to a ground line of said coaxial cable, and an insulator for providing electrical insulation between said inner conductor and said outer conductor;

a flat member made of a good electrically conductive material and disposed in said housing to face said first bores;

first arms formed by cutting and raising those portions of said flat member which are associated one-to-one with said first bores, each of said first arms for electrical connection to a respective said outer conductor of a respective said coaxial pin;

a plurality of second bores extending toward said flat member from a second surface of said housing which is opposite to said first surface, each of said second bores for respectively receiving a ground pin; and second arms formed by cutting and raising those portions of said flat member which are associated one-to-one with said second bores, each of said second arms for electrical connection to a respective said ground pin, wherein said flat member extends in a substantially perpendicular direction to the direction of insertion of each said coaxial pin into a respective one of said first bores, said first arms extend in a direction opposite to the direction of insertion of each said coaxial pin into a respective one of said first bores, and said second arms extend in a direction opposite to the direction of insertion of each said ground pin into a respective one of said second bores.

16. A connector as set forth in claim 15, further comprising:

third bores extending from said second surface toward said first arms, each said third bore for receiving a signal pin for electrical connection to a respective said inner conductor of a respective said coaxial pin.

17. A connector as set forth in claim 15, wherein said predetermined length of each of said first bores is about four times greater than the height of each of said first arms.

18. A connector as set forth in claim 15, wherein said first arms are resilient for respectively resiliently retaining each said coaxial pin and said second arms are resilient for respectively resiliently retaining each said ground pin.

19. A connector as set forth in claim 18, wherein said first arms have electrical conductivity with respect to high frequencies.

20. A connector as set forth in claim 18, wherein said flat member is made of stainless steel plated with gold.

21. A connector as set forth in claim 15, wherein the upper end of each of said first arms has a pawl for engaging with the outer periphery of a respective said coaxial pin.

22. A connector as set forth in claim 21, wherein each said pawl is adapted to engage with a circumferential recess on said outer periphery of a respective said coaxial pin.

23. A connector as set forth in claim 15, wherein said connector is divided into a plurality of blocks, each of said plurality of blocks including a respective portion of said housing, a respective said flat member, respective said first arms, respective said second arms, respective said first bores, and respective said second bores.

24. A connector as set forth in claim 17, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

25. A connector as set forth in claim 16, wherein said first arms are resilient for respectively resiliently retaining each said coaxial pin, and said second arms are resilent for respectively resiliently retaining each said ground pin.

26. A connector as set forth in claim 16, wherein said predetermined length of each of said first bores is about four times greater than the height of each said first arms.

27. A connector as set forth in claim 16, wherein said connector is divided into a plurality of blocks, each of said plurality of blocks including a respective portion of said housing, a respective said flat member, respective said first arms, respective said second arms, respective said first bores, respective said second bores, and respective said third bores.

28. A connector as set forth in claim 27, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

29. A connector comprising:

a housing having a first surface and a plurality of first bores extending from said first surface, each of said first bores for respectively receiving a coaxial pin and having a predetermined length, each said coaxial pin having an inner conductor for connection to a signal line of a coaxial cable, an outer conductor for connection to a ground line of said coaxial cable, and an insulator for providing electrical insulation between said inner conductor and said outer conductor;

a flat member made of a good electrically conductive material and disposed in said housing to face said first bores;

first arms formed by cutting and raising those portions of said flat member which are associated one-to-one with said first bores, each of said first arms for electrical connection to a respective said outer conductor of a respective said coaxial pin;

a plurality of second bores extending toward said flat member from a second surface of said housing which is opposite to said first surface, each of said second bores for respectively receiving a ground pin; and second arms formed by cutting and raising those portions of said flat member which are associated one-to-one with said second bores, each of said second arms for electrical connection to a respective said ground pin, wherein said first arms extend in a direction opposite to the direction of insertion of each said coaxial pin into a respective one of said first bores, and said second arms extend in a direction opposite to the direction of insertion of each said ground pin into a respective one of said second bores.

30. A connector as set forth in claim 29, wherein said connector is divided into a plurality of blocks, each of said plurality of blocks including a respective portion of said housing, a respective said flat member, respective said first arms, respective said second arms, respective said first bores and respective said second bores.

31. A connector as set forth in claim 29, wherein said first arms are resilient for respectively resiliently retaining each said coaxial pin and said second arms are resilient for respectively resiliently retaining each said ground pin.

32. A connector as set forth in claim 31, wherein said first arms have electrical conductivity with respect to high frequencies.

33. A connector as set forth in claim 31, wherein said flat member is made of stainless steel plated with gold.

34. A connector as set forth in claim 29, wherein the upper end of each of said first arms has a pawl for engaging with the outer periphery of a respective said coaxial pin.

35. A connector as set forth in claim 34, wherein each said pawl is adapted to engage with a circumferential recess on said outer periphery of a respective said coaxial pin.

36. A connector as set forth in claim 29, further comprising:

third bores extending from said second surface toward said first arms, each said third bore for receiving a signal pin for electrical connection to a respective said inner conductor of a respective said coaxial pin.

37. A connector as set forth in claim 36, wherein said connector is divided into a plurality of blocks, each of said plurality of blocks including a respective portion of said housing, a respective said flat member, respective said first arms, respective said second arms, respective said first bores, respective said second bores, and respective said third bores.

38. A connector comprising:

a housing having a first surface and a plurality of first bores extending from said first surface, each of said first bores for respectively receiving a coaxial pin and having a predetermined length, each said coaxial pin having an inner conductor for connection to a signal line of a coaxial cable, an outer conductor for connection to a ground line of said coaxial cable, and an insulator for providing electrical insulation between said inner conductor and said outer conductor;

a flat member made of a good electrically conductive material and disposed in said housing to face said first bores;

first arms formed by cutting and raising those portions of said flat member which are associated one-to-one with said first bores, each of said first arms for electrical connection to a respective said outer conductor of a respective said coaxial pin;

a plurality of second bores extending toward said flat member from a second surface of said housing which is opposite to said first surface, each of said second bores for respectively receiving a ground pin; and second arms formed by cutting and raising those portions of said flat member which are associated one-to-one with said second bores, each of said second arms for electrical connection to a respective said ground pin, wherein said first arms extend in the same direction as the direction of insertion of each said coaxial pin into a respective one of said first bores, and said second arms extend in the same direction as the direction of insertion of each said ground pin into a respective one of said second bores.

39. A connector as set forth in claim 38, wherein said flat member extends in a substantially perpendicular direction to the direction of insertion of each said coaxial pin into a respective one of said first bores.

40. A connector as set forth in claim 39, wherein said first arms are resilent for respectively resiliently retaining each said coaxial pin and said second arms are resilient for respectively resiliently retaining each said ground pin.

41. A connector as set forth in claim 40, wherein said first arms have electrical conductivity with respect to high frequencies.

42. A connector as set forth in claim 40, wherein said flat member is made of stainless steel plated with gold.

43. A connector as set forth in claim 38, wherein said flat member extends in a substantially perpendicular direction to the direction of insertion of each said coaxial pin into a respective one of said first bores and said predetermined length of each of said first bores is about four times greater than the height of each of said first arms.

44. A connector as set forth in claim 38, wherein the upper end of each of said first arms has a pawl for engaging with the outer periphery of a respective said coaxial pin.

45. A connector as set forth in claim 44, wherein each said pawl is adapted to engage with a circumferential recess on said outer periphery of a respective said coaxial pin.

46. A connector as set forth in claim 38, wherein said connector is divided into a plurality of blocks, each of said plurality of blocks including a respective portion of said housing, a respective said flat member, respective said first arms, respective said second arms, respective said first bores and respective said second bores.

47. A connector as set forth in claim 46, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

48. A connector as set forth in claim 38, further comprising:

third bores extending from said second surface toward said first arms, each said third bore for receiving a signal pin for electrical connection to a respective said inner conductor of a respective said coaxial pin.

49. A connector as set forth in claim 48, wherein said flat member extends in a direction substantially perpendicular to the direction of insertion of each said coaxial pin into a respective one of said first bores, said first arms are resilient for respectively resiliently retaining each said coaxial pin, and said second arms are resilient for respectively resiliently retaining each said ground pin.

50. A connector as set forth in claim 48, wherein said flat member extends in a substantially perpendicular direction to the direction of insertion of each said coaxial pin into a respective one of said first bores and said predetermined length of each of said first bores is about four times greater than the height of each of said first arms.

51. A connector as set forth in claim 48, wherein said connector is divided into a plurality of blocks, each of said plurality of blocks including a respective portion of said housing, a respective said flat member, respective said first arms, respective said second arms, respective said first bores, respective said second bores, and respective said third bores.

52. A connector as set forth in claim 51, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

53. A connector comprising:

a housing having a first surface and a plurality of first bores extending from said first surface, each of said first bores for respectively receiving a coaxial pin and having a predetermined length, each said coaxial pin having an inner conductor for connecting to a signal line of a coaxial cable, an outer conductor for connection to a ground line of said coaxial cable, and an insulator for providing electrial insulation between said inner conductor and said outer conductor;

a flat member made of a good electrically conductive material and disposed in said housing to face said first bores;

first arms formed by cutting and raising those portions of said flat member which are associated one-to-one with said first bores, each of said first arms for electrical connection to a respective said outer conductor of a respective said coaxial pin;

a plurality of second bores extending toward said flat member from a second surface of said housing which is opposite to said first surface, each of said second bores for respectively receiving a ground pin; and second arms formed by cutting and raising those portions of said flat member which are associated one-to-one with said second bores, each of said second arms for electrical connection to a respective said ground pin, wherein said first arms and said second arms extend in the same direction.

54. A connector as set forth in claim 53, wherein said flat member extends in a substantially perpendicular direction to the direction of insertion of each said coaxial pin into a respective one of said first bores.

55. A connector as set forth in claim 54, wherein said first arms are resilent for respectively resiliently retaining each said coaxial pin and said second arms are resilient for respectively resiliently retaining each said ground pin.

56. A connector as set forth in claim 55, wherein said first arms have electrical conductivity with respect to high frequencies.

57. A connector as set forth in claim 55, wherein said flat member is made of stainless steel plated with gold.

58. A connector as set forth in claim 53, wherein said flat member extends in a substantially perpendicular direction to the direction of insertion of each said coaxial pin into a respective one of said first bores and said predetermined length of each of said first bores is about four times greater that the height of each of said first arms.

59. A connector as set forth in claim 53, wherein the upper end of each of said first arms has a pawl for engaging with the outer periphery of a respective said coaxial pin.

60. A connector as set forth in claim 59, wherein each said pawl is adapted to engage with a circumferential recess on said outer periphery of a respective said coaxial pin.

61. A connector as set forth in claim 53, wherein said connector is divided into a plurality of blocks, each of said plurality of blocks including a respective portion of said housing, a respective said flat member, respective said first arms, respective said second arms, respective said first bores and respective said second bores.

62. A connector as set forth in claim 61, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

63. A connector as set forth in claim 53, further comprising:

third bores extending from said second surface toward said first arms, each said third bore for receiving a signal pin for electrical connection to a respective said inner conductor of a respective said coaxial pin.

64. A connector as set forth in claim 63, wherein said flat member extends in a direction substantially perpendicular to the direction of insertion of each said coaxial pin into a respective one of said first bores, said first arms are resilient for respectively resiliently retaining each said coaxial pin, and said second arms are resilient for respectively resiliently retaining each said ground pin.

65. A connector as set forth in claim 63, wherein said flat member extends in a substantially perpendicular direction to the direction of insertion of each said coaxial pin into a respective one of said first bores and said predetermined length of each of said first bores is about four times greater than the height of each of said first arms.

66. A connector as set forth in claim 63, wherein said connector is divided into a plurality if blocks, each of said plurality of blocks including a respective portion of said housing, a respective said flat member, respective said first arms, respective said second arms, respective said first bores, respective said second bores, and respective said third bores.

67. A connector as set forth in claim 66, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

68. A connector comprising:

a housing having a first surface and a plurality of first bores extending from said first surface, each of said first bores for respectively receiving a coaxial pin and having a predetermined length, each said coaxial pin having an inner conductor for connection to a signal line of a coaxial cable, an outer conductor for connection to a ground line of said coaxial cable, and an insulator for providing electrical insulation between said inner conductor and said outer conductor;

a flat member made of a good electrically conductive material and disposed in said housing to face said first bores;

first arms formed by cutting and raising those portions of said flat member which are associated one-to-one with said first bores, each of said first arms for electrical connection to a respective said outer conductor of a respective said coaxial pin;

a plurality of second bores extending toward said flat member from a second surface of said housing which is opposite to said first surface, each of said second bores for respectively receiving a ground pin; and second arms formed by cutting and raising those portions of said flat member which are associated one-to-one with said second bores, each of said second arms for electrical connection to a respective said ground pin, wherein said first arms extend in a direction opposite to the direction said second arms extend.

69. A connector as set forth in claim 68, wherein said flat member extends in a substantially perpendicular direction to the direction of insertion of each said coaxial pin into a respective one of said first bores and said predetermined length of each of said first bores is about four times greater than the height of each of said first arms.

70. A connector as set forth in claim 68, wherein said flat member extends in a substantially perpendicular direction to the direction of insertion of each said coaxial pin into a respective one of said first bores.

71. A connector as set forth in claim 70, wherein said first arms are resilient for respectively resiliently retaining each said coaxial pin and said second arms are resilient for respectively resiliently retaining each said ground pin.

72. A connector as set forth in claim 71, wherein said first arms have electrical conductivity with respect to high frequencies.

73. A connector as set forth in claim 71, wherein said flat member is made of stainless steel plated with gold.

74. A connector as set forth in claim 68, wherein the upper end of each of said first arms has a pawl for engaging with the outer periphery of a respective said coaxial pin.

75. A connector as set forth in claim 74, wherein each said pawl is adapted to engage with a circumferential recess on said outer periphery of a respective said coaxial pin.

76. A connector as set forth in claim 68, wherein said connector is divided into a plurality of blocks, each of said plurality of blocks including a respective portion of said housing, a respective said flat member, respective said first arms, respective said second arms, respective said first bores and respective said second bores.

77. A connector as set forth in claim 76, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

78. A connector as set forth in claim 68, further comprising:

third bores extending from said second surface toward said first arms, each said third bore for receiving a signal pin for electrical connection to a respective said inner conductor of a respective said coaxial pin.

79. A connector as set forth in claim 78, wherein said flat member extends in a direction substantially perpendicular to the direction of insertion of each said coaxial pin into a respective one of said first bores, said first arms are resilient for respectively resiliently retaining each said coaxial pin, and said second arms are resilient for respectively resiliently retaining each said ground pin.

80. A connector as set forth in claim 78, wherein said flat member extends in a substantially perpendicular direction to the direction of insertion of each said coaxial pin into a respective one of said first bores and said predetermined length of each of said first bores is about four times greater than the height of each of said first arms.

81. A connector as set forth in claim 78, wherein said connector is divided into a plurality of blocks, each of said plurality of blocks including a respective portion of said housing, a respective said flat member, respective said first arms, respective said second arms, respective said first bores, respective said second bores, and respective said third bores.

82. A connector as set forth in claim 81, wherein each respective said flat member extends in a substantially perpendicular direction to the direction of insertion of each said coaxial pin into a respective one of said first bores, said first arms are resilient for respectively resiliently retaining each said coaxial pin, and said second arms are resilient for respectively resiliently retaining each said ground pin.

* * * * *